US007064739B2

(12) United States Patent
Sekido et al.

(10) Patent No.: US 7,064,739 B2
(45) Date of Patent: Jun. 20, 2006

(54) LIQUID CRYSTAL DISPLAY AND DRIVER THEREOF

(75) Inventors: Satoshi Sekido, Kawasaki (JP); Syouichi Fukutoku, Kawasaki (JP); Katsuyoshi Hiraki, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 366 days.

(21) Appl. No.: 10/386,788

(22) Filed: Mar. 12, 2003

(65) Prior Publication Data

US 2003/0184511 A1 Oct. 2, 2003

(30) Foreign Application Priority Data

Mar. 29, 2002 (JP) ..... 2002-096903

(51) Int. Cl.
*G09G 3/36* (2006.01)

(52) U.S. Cl. ..... 345/99; 345/98; 345/100; 345/204

(58) Field of Classification Search ..... 345/98–100, 345/204
See application file for complete search history.

(56) References Cited

U.S. PATENT DOCUMENTS 5,592,199 A 1/1997 Kawaguchi et al. ..... 345/206
5,670,994 A 9/1997 Kawaguchi et al. ..... 345/206
6,476,789 B1 * 11/2002 Sakaguchi et al. ..... 345/100
6,603,466 B1 * 8/2003 Sakaguchi et al. ..... 345/204
6,862,015 B1 * 3/2005 Fujioka et al. ..... 345/98

FOREIGN PATENT DOCUMENTS

JP 6-258651 9/1994
JP 7-49657 2/1995
JP 2000-227783 8/2000

* cited by examiner

*Primary Examiner*—Kent Chang
*Assistant Examiner*—Tammy Pham
(74) *Attorney, Agent, or Firm*—Greer, Burns & Crain, Ltd.

(57) ABSTRACT

It is the object to provide a liquid crystal display to prevent adverse effects by crosstalk and/or EMI. A liquid crystal display, which has a transistor board having a plurality of transistors each including a gate, a source and a drain, a common board including a common electrode and provided to oppose the aforesaid transistor board via liquid crystal, a gate driver for driving the gates of a plurality of transistors, and a source driver with a plurality of source driver units being cascaded, for driving the sources of a plurality of transistors, is provided. Each of the source driver units has flip-flops operated in synchronism with a clock signal, and inverters for inverting the clock signal to output it to the source driver unit in a next stage.

20 Claims, 8 Drawing Sheets

LIQUID CRYSTAL DISPLAY AND DRIVER THEREOF

CROSS-REFERENCE TO RELATED APPLICATIONS

This application is based upon and claims the benefit of priority from the prior Japanese Patent Application No. 2002-096903, filed on Mar. 29, 2002, the entire contents of which are incorporated herein by reference.

BACKGROUND OF THE INVENTION

1. Field of the Invention

The present invention relates to a liquid crystal display and a driver thereof, and particularly relates to a driver in which a plurality of driver units are cascaded.

2. Description of the Related Art

In addition to space saving of monitors of personal computers, increases in the number of pixels and display size are required. A liquid crystal display has a structure in which a thin-film transistor (TFT) board and a common board are bonded together to oppose each other and hold liquid crystal therebetween. The liquid crystal is given gradation according to a transmission amount of light corresponding to a potential difference between pixel electrodes of the TFT board and a common electrode of the common substrate.

A driver of the liquid crystal display performs the above-described gradation display by driving the above-described TFT. On this occasion, if signals on a plurality of signal wires change at the same time, influences of the individual signals become large and have an adverse effect on crosstalk and electromagnetic interference (EMI).

SUMMARY OF THE INVENTION

An object of the present invention is to provide a liquid crystal display and a driver thereof to prevent adverse effects by crosstalk and/or EMI.

According to an aspect of the present invention, a liquid crystal display having a transistor board having a plurality of transistors each including a gate, a source and a drain, a common board including a common electrode and provided to oppose the transistor substrate via liquid crystal, a gate driver for driving the gates of the plurality of transistors, and a source driver in which a plurality of source driver units are cascaded to drive the sources of the plurality of transistors is provided. Each of the source driver units has flip-flops, inverters, and an output circuit. In each of the flip-flops, a wire of a clock signal inputted from the source driver unit in a previous stage or an outside is connected to a clock terminal, a wire of an input signal inputted from the source driver unit in the previous stage or the outside is connected to an input terminal, and a wire for outputting an output signal to the source driver unit in a next stage or the outside is connected to an output terminal. In each of the inverters, the wire of the clock signal inputted from the source driver unit in the previous stage or the outside is connected to an input terminal and the wire for outputting the clock signal to the source driver unit in the next stage or the outside is connected to an output terminal. The output circuit outputs a signal to the source of the transistor of the transistor board corresponding to the input signal inputted from the source driver unit in the previous stage or the outside.

The inverter inverts the inputted clock signal, and outputs it to the source driver unit in the next stage. As a result, in the even-numbered source driver units and the odd-numbered source driver units, the clock signals are inverted from each other. These non-inverting clock signal and inverting clock signal cancel out each other, and adverse effects of crosstalk and/or EMI can be prevented. In the even-numbered source driver units and the odd-numbered source driver units, the flip-flops are operated in synchronism with the clock signals inverted from each other, and therefore the points of change of the output signals differ from each other. As a result, the time points of change of the output signals are distributed, and the adverse effects of crosstalk and/or EMI can be prevented.

DETAILED DESCRIPTION OF THE PREFERRED EMBODIMENTS

First Embodiment

Figure 1:
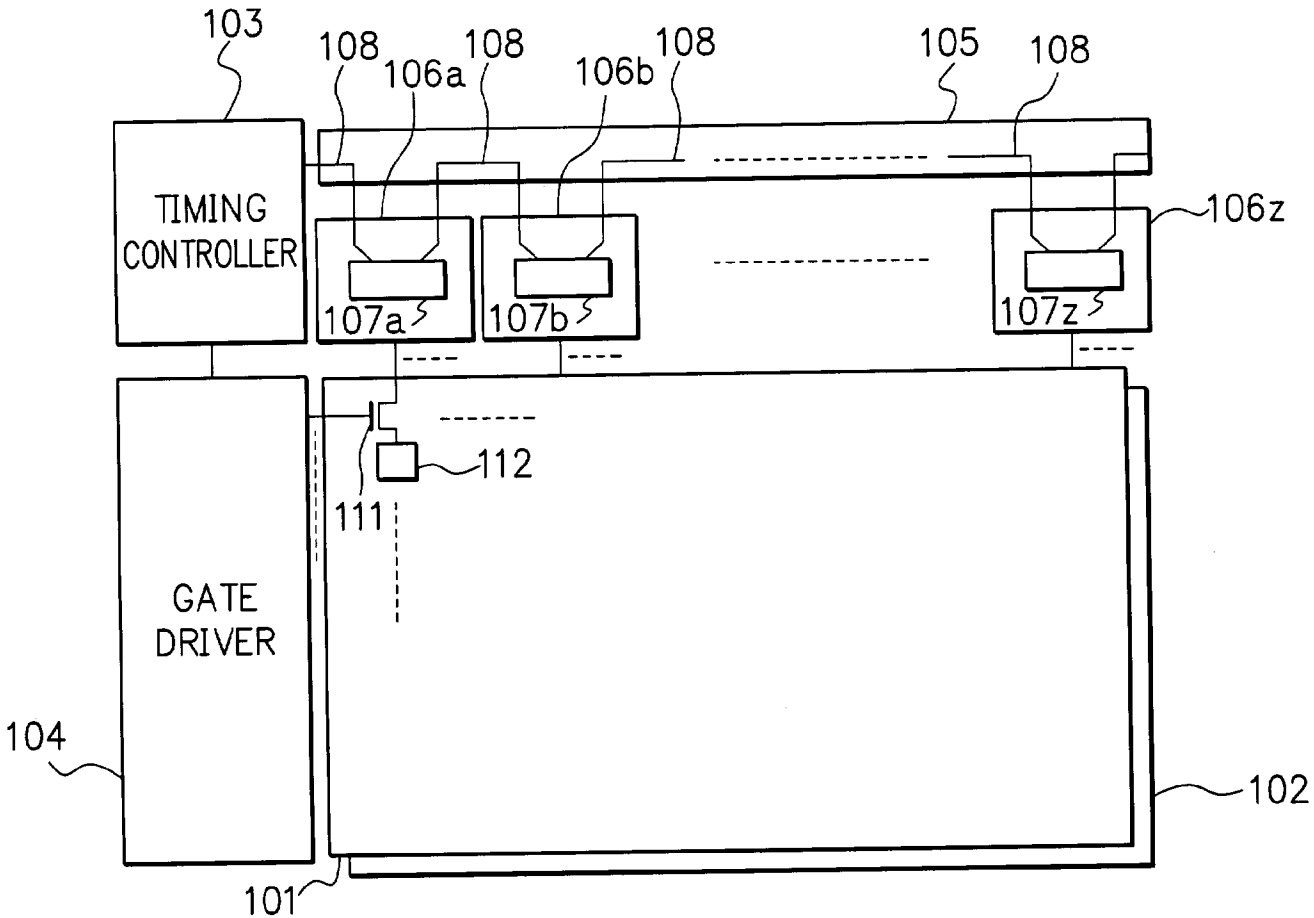
FIG. 1 is a block diagram showing a constitution of a liquid crystal display according to a first embodiment of the present invention.

FIG. 1 is a view showing a constitution of a liquid crystal display according to a first embodiment of the present invention. A thin-film transistor (TFT) board 101 has a plurality of n-channel MOS transistors 111, which are arranged in a two-dimensional matrix form. Each of the transistors has a gate, a source and a drain. A common board 102 includes a common electrode formed on an entire surface of the board, and is provided to oppose the TFT board 101 via liquid crystal. The common electrode is connected to a ground potential. In the transistor 111, the gate is connected to a gate driver 104, the source is connected to a source driver unit 107*a* and the like, and the drain is connected to a pixel electrode 112. A transmission amount of light of the liquid crystal changes according to potential differences between the pixel electrodes 112 and the common electrode of the common board 102, and thereby gradation display can be performed. A timing controller 103 supplies a gate clock signal, gate start pulse and the like to the gate driver 104. The gate driver 104 drives the gates of the transistors 111 according to the gate clock signal and the like.

A source driver has a plurality of source driver units 107*a*, 107*b*, . . . , and 107*z* cascaded with wires 108, and drives the sources of a plurality of transistors (drive elements) 111. The source driver units 107*a*, 107*b*, . . . , and 107*z* have the same constitutions, and they are formed on TABs (tape automated bondings) 106*a*, 106*b*, . . . , and 106*z*, respectively. A printed board 105 is a board to form the wire 108 between the timing controller 103 and the TAB 106*a*, and the wires 108 to cascade a plurality of source driver units 107*a* to 107*z*.

Hereinafter, all or each of the TABs 106*a*, 106*b*, and 106*z* will be called a TAB 106. Each of the source driver units 107*a*, 107*b*, . . . , and 107*z* will be called a source driver unit 107.

The timing controller 103 supplies clock signals, display data, and control signals to a plurality of source driver units 107 via the wires 108. Each of the source driver units 107 performs timing adjustment of the inputted signals and outputs them to the source driver unit 107 in the next stage. Each of the source driver units 107 drives the sources of, for example, 384 transistors 111 based on the above-described inputted signals.

Figure 2:
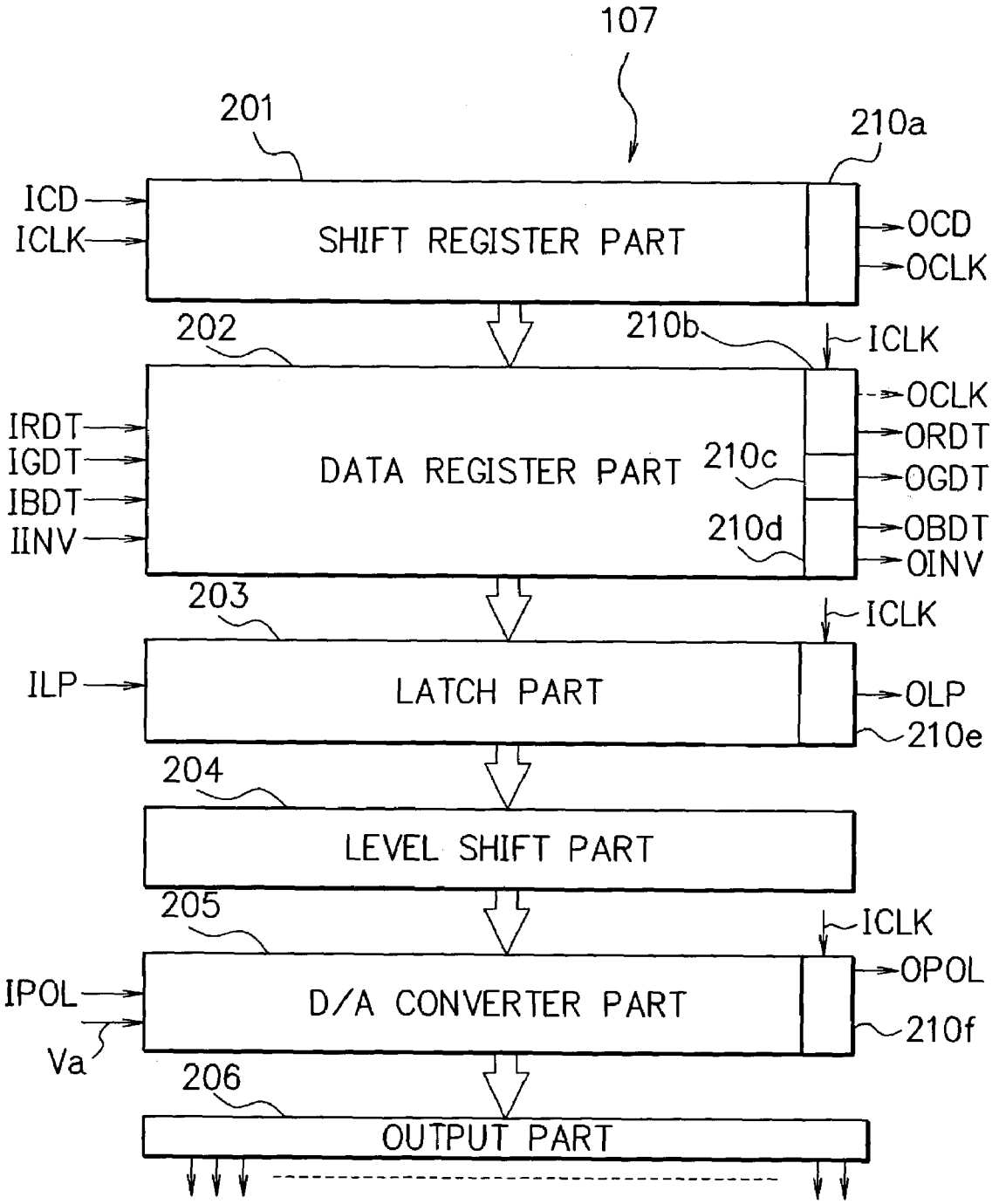
FIG. 2 is a block diagram showing a constitution of a source driver unit.

FIG. 2 shows a constitution of each of the source driver units 107. A shift resistor part 201 inputs a cascade signal ICD and a clock signal ICLK from the timing controller 103 or the source driver unit 107 in the previous stage, shifts the cascade signal ICD, and supplies storage timing pulse to a data register part 202. The data register part 202 inputs red display data IRDT, green display data IGDT, and blue display data IBDT from the timing controller 103 or the source driver unit 107 in the previous stage, and stores the display data IRDT, IGDT, and IBDT according to the above-described storage timing pulse. As for the transistors 111 (FIG. 1), for example, the transistors for red, green and blue are arranged in this order repeatedly in the horizontal direction in the drawing. Correspondingly to this, registers inside the data register part 202 are also arranged repeatedly in the order of the registers for red, green, and blue. The registers store the display data in the order of the registers from the left side of the drawing to the right side. When the storing is finished, a cascade signal OCD which is a result of the cascade signal ICD being shifted is outputted to the source driver unit 107 in the next stage, and in the source driver unit 107 in the next stage, the display data are stored in sequence. Display data ORDT, OGDT and OBDT are the display data IRDT, IGDT and IBDT with timing adjustment being performed, and are supplied to the source driver unit 107 in the next stage. A data inverting signal IINV is also inputted into the data register part 202.

When the data register parts 202 of all the source driver units 107 finish storing the display data IRDT and the like, a latch part 203 inputs therein latch pulse LP from the timing controller 103 or the source driver unit 107 in the previous stage, and latches the display data IRDT and the like which are stored in the data register part 202. A level shift part 204 converts, for example, 8 bits of the display data IRDT and the like, which the latch part 203 latches, into gradation data.

A D/A converter part 205 inputs therein a polarity inverting signal IPOL and a reference power supply Va from the timing controller 103 or the source driver unit 107 in the previous stage, and converts the gradation data in a digital form, which is outputted by the level shift part 204, into an analogue form based on the reference power supply Va. The D/A converter part 205 outputs gradation data at either a positive potential or a negative potential correspondingly to the polarity inverting signal IPOL. In FIG. 1, the common electrode of the common board 102 is at a ground potential, and the gradation data at a positive potential and the gradation data at a negative potential are alternately supplied to the sources of the transistors 111 for each frame or field. As a result, the life of the liquid crystal can be elongated. An output part 206, which has an operational amplifier, amplifies the gradation data which is outputted by the D/A converter part 205, and outputs it to the source of the transistor 111 in FIG. 1.

Next, timing adjusting circuits 210*a* to 210*f* will be explained. The timing adjusting circuit 210*a* adjusts a timing of the clock signal ICLK to output the clock signal OCLK, and performs timing adjustment of the signal which is the cascade signal ICD shifted by the shift register part 201 to output it as the cascade signal OCD. The cascade signal OCD and the clock signal OCLK are inputted into the source driver unit 107 in the next stage as the cascade signal ICD and the clock signal ICLK.

In synchronization with the clock signal ICLK, the timing adjusting circuits 210*b*, 210*c* and 210*d* perform timing adjustment of the respective display data IRDT, IGDT and IBDT and output them as the display data ORDT, OGDT and OBDT. Instead of the timing adjusting circuit 210*a*, the timing adjusting circuit 210*b* or the like may output the clock signal OCLK. The display data ORDT, OGDT and OBDT are inputted into the source driver unit 107 in the next stage as the display data IRDT, IGDT and IBDT. The timing adjusting circuit 210*d* may perform timing adjustment of the data inverting signal IINV other than the display data OBDT and may output it as a data inverting signal OINV, in synchronism with the clock signal ICLK, or some other timing adjusting circuit may output the data inverting signal OINV.

Similarly, the timing adjusting circuits 210*e* and 210*f* perform timing adjustment of latch pulse ILP and the polarity inverting signal IPOL and output them as latch pulse OLP and a polarity inverting signal OPOL, respectively, in synchronism with the clock signal ICLK. The latch pulse OLP and the polarity inverting signal OPOL are inputted into the source driver unit 107 in the next stage as the latch pulse ILP and the polarity inverting signal IPLO, respectively.

As described above, the timing adjusting circuits 210*a* to 210*f* perform timing adjustment of the display data or the control signals and outputs them to the source driver unit 107 in the next stage, in synchronism with the clock signal ICLK. Here, the control signals include the above-described cascade signal ICD, latch pulse ILP, data inverting signal IINV and polarity inverting signal IPOL. It is sufficient if any one of the timing adjusting circuits 210*a* to 210*f* outputs the clock signal OCLK. All the timing adjusting circuits 210*a* to 210*f* have the same circuit constitutions, and therefore, the explanation will be made below with the timing adjusting circuit 210*b* as an example. On this occasion, the explanation is made with the timing adjusting circuit 210*b* outputting the clock signal OCLK other than the display data ORDT.

Figure 3A:
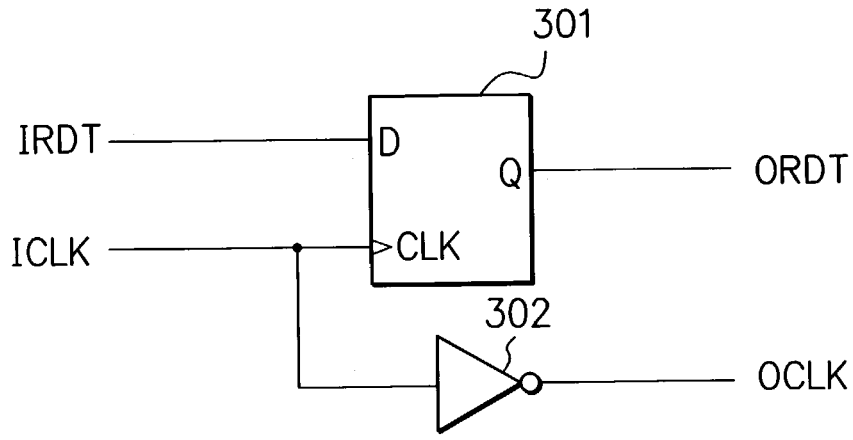
FIGS. 3A to 3C are circuit diagrams showing constitution examples of a timing adjusting circuit according to the first embodiment.

FIG. 3A shows a constitution example of the timing adjusting circuit 210*b*. In a D-type flip-flop 301, a wire of the clock signal ICLK is connected to a clock terminal CLK, a wire of the input signal (display data) IRDT is connected to an input terminal D, and a wire for outputting an output signal (display data) ORDT is connected to an output terminal Q. In an inverter 302, the wire of the clock signal ICLK is connected to an input terminal, and a wire for outputting the clock signal OCLK is connected to an output terminal.

Figure 4:
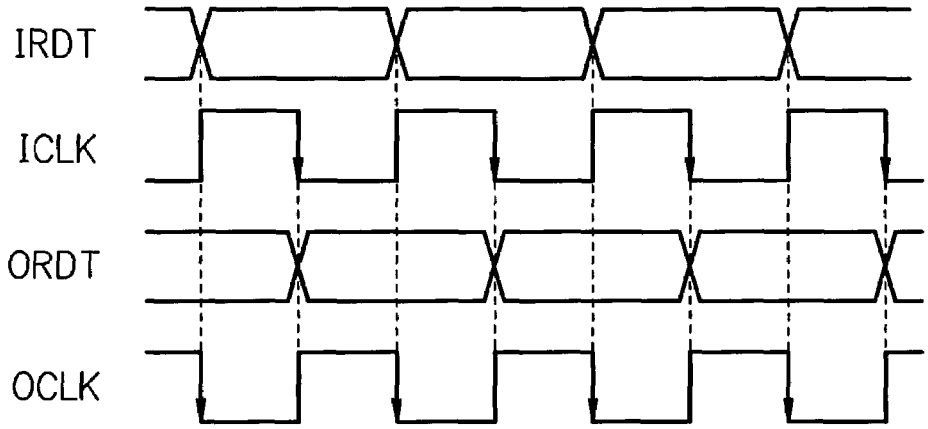
FIG. 4 is a timing chart to explain an operation of the timing adjusting circuit in FIG. 3A.

FIG. 4 is a timing chart to explain an operation of FIG. 3A. The flip-flop 301 outputs the input signal IRDT as the output signal ORDT in synchronism with a falling edge of the clock signal ICLK. The inverter 302 performs logical inversion (phase inversion) of the clock signal ICLK to output the clock signal OCLK. As a result, the clock signals ICLK and OCLK have their phases inverted from each other, and therefore they cancel out the effects of crosstalk and EMI on each other. The signals IRDT and ORDT have the points of change deviated with respect to time, and therefore the peaks of crosstalk and EMI can be distributed with respect to time and relieved. By the above-described operation, adverse effects by crosstalk and EMI can be prevented as a whole.

Figure 5:
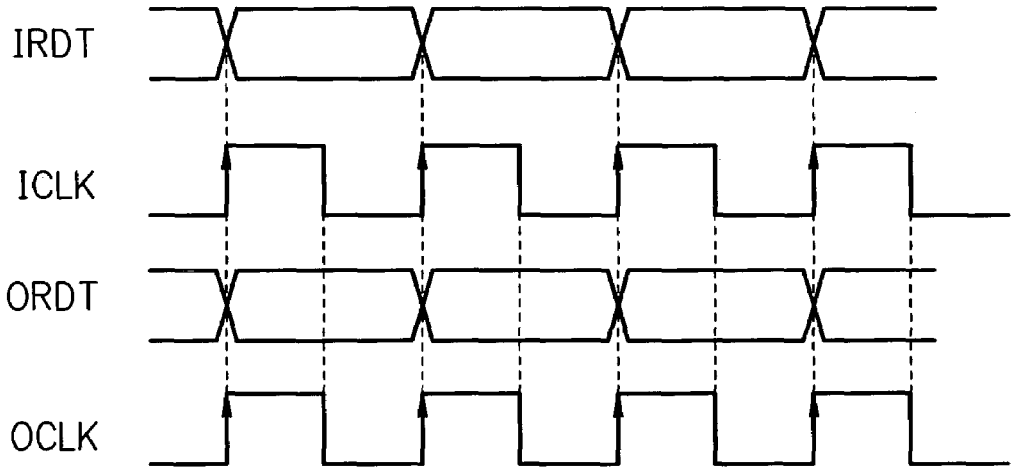
FIG. 5 is a reference timing chart to explain an effect of the timing adjusting circuit in FIG. 3A.

FIG. 5 is a timing chart when the inverter 302 in FIG. 3A does not exist, and it will be explained as compared with FIG. 4. It can be actually considered to remove the inverter 302, or provide a buffer instead of the inverter 302. To make the drawing simple and plain, the explanation will be made with the case in which the flip-flop is operated in synchronism with a rising edge as an example, but the explanation is the same in the case in which it is operated in synchronism with a falling edge. In this case, the clock signal OCLK has the same phase as the clock signal ICLK. The signals IRDT and ORDT have the same points of change. As a result, the clock signals ICLK and OCLK have the same phase, and therefore the peaks of crosstalk and EMI increase at the rising edge and the falling edge. Since the signals IRDT and ORDT have the same point of change, the peaks of crosstalk and EMI increase at the point of change.

According to this embodiment, by providing the inverter 302, the phases of the clock signals ICLK and OCLK are inverted, and the points of change of the signals IRDT and ORDT are deviated from each other, as shown in FIG. 4, and therefore crosstalk and EMI can be prevented.

Figure 3B:
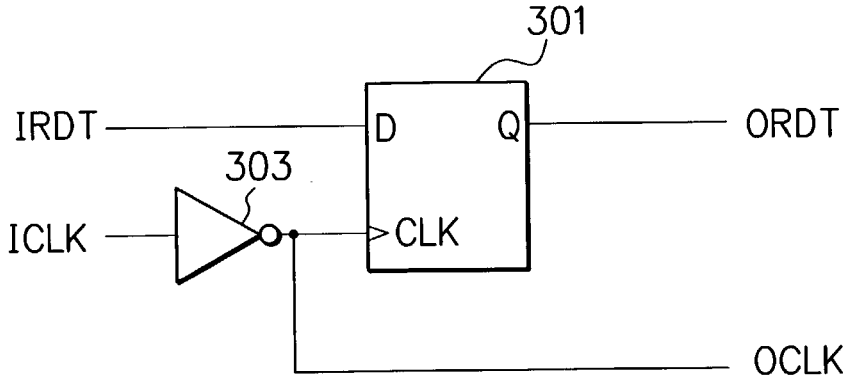

FIG. 3B shows another constitution example of the timing adjusting circuit 210*b*. Here, an inverter 303 is connected instead of the inverter 302 in FIG. 3A. In the inverter 303, the wire of the clock signal ICLK is connected to an input terminal, and the wire for outputting the clock signal OCLK is connected to an output terminal. In the flip-flop 301, the output terminal of the inverter 303 is connected to the clock terminal CLK, the wire of the input signal IRDT is connected to the input terminal D, and the wire for outputting the output signal ORDT is connected to the output terminal Q. While in the circuit in FIG. 3A, the inverter 302 is provided in an output stage, the inverter 303 is provided in an input stage in FIG. 3B. The operation of the circuit in FIG. 3B is the same as FIG. 4.

Figure 3C:
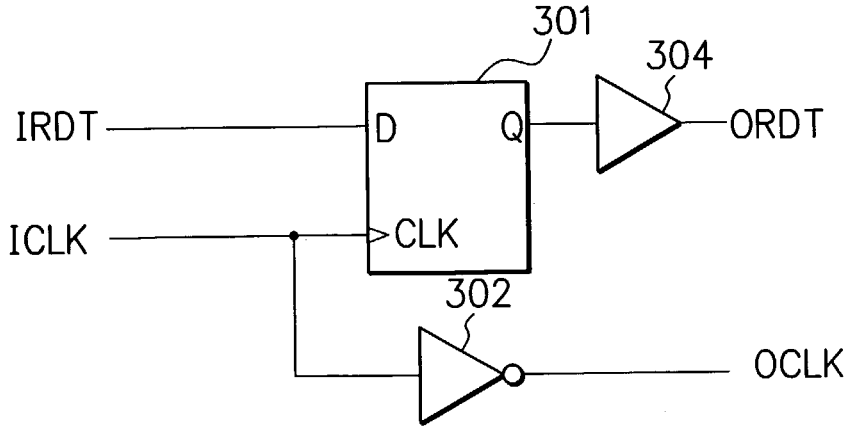

FIG. 3C shows still another constitution example of the timing adjusting circuit 210*b*. This circuit is the circuit in FIG. 3A provided with a buffer 304. In the buffer 304, the output terminal Q of the flip-flop 301 is connected to an input terminal thereof, and the wire for outputting the output signal ORDT is connected to an output signal thereof. The buffer 304 corresponds to the inverter 302, and is for adjusting a delay time of the output signal ORDT. Similarly, the buffer 304 may be added to the circuit in FIG. 3B.

Second Embodiment

A liquid crystal display according to a second embodiment of the present invention is basically the same as the constitutions shown in FIG. 1 and FIG. 2, and it differs only in an internal constitution of the timing adjusting circuits 210*a* to 210*f*. The explanation will be made below with the timing adjusting circuit as an example.

Figure 6A:
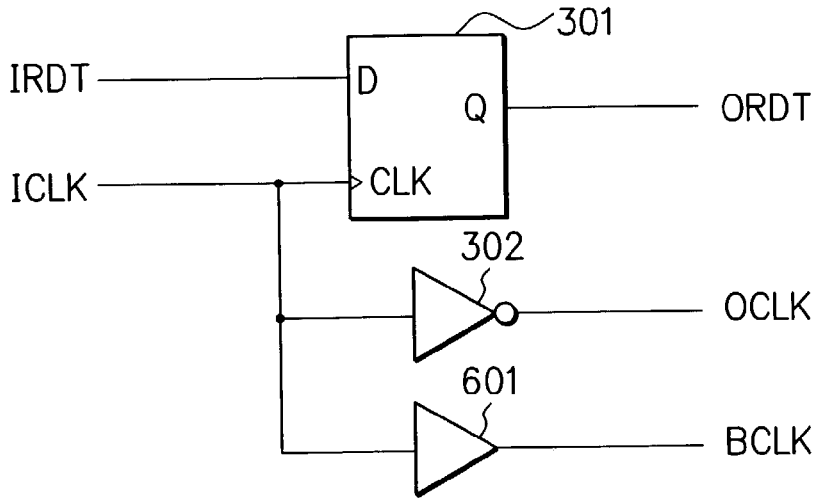
FIGS. 6A and 6B are circuit diagrams showing constitution examples of a timing adjusting circuit according to a second embodiment of the present invention.

FIG. 6A shows a constitution example of the timing adjusting circuit 210*b* according to this embodiment. This circuit is the circuit in FIG. 3A to which a buffer 601 is added. In the buffer 601, the wire of the clock signal ICLK is connected to an input terminal, and a wire of a clock signal BCLK is connected to an output terminal. The buffer 601 amplifies the clock signal ICLK and outputs it as the clock signal BCLK.

Figure 7:
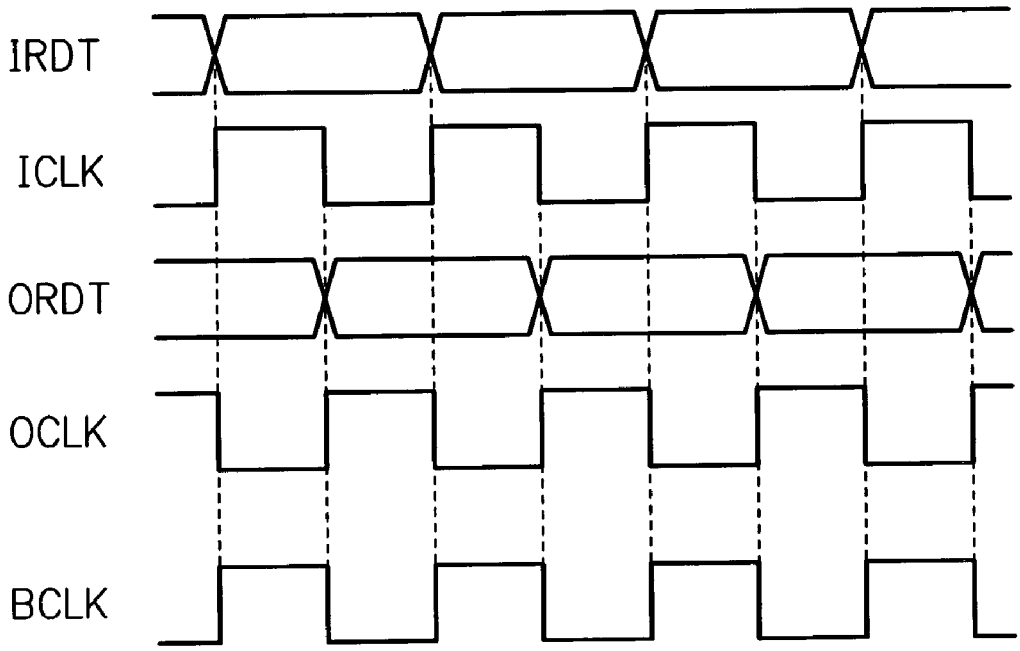
FIG. 7 is a timing chart to explain an operation of the timing adjusting circuit in FIG. 6A.

AS shown in FIG. 7, with the input clock signal ICKL being made a reference, the clock signal OCLK is the inverting clock signal, and the clock signal BCLK is a non-inverting signal. The clock signals OCLK and BCLK are the signals with their phase being inverted from each other. The wires of the clock signals OCLK and BCLK are laid on the TAB 106 and the printed board 105 in FIG. 1 in close vicinity to each other, whereby the action by crosstalk and EMI on both of them are cancelled out by each other, and adverse effects by the crosstalk and EMI can be further prevented. The clock signal BCLK has a dummy wire, which is not used in the circuit operation.

The wire of the clock signal OCLK of the source driver unit 107 in the previous stage is connected to the clock terminal CLK of the flip-flop 301 of the source driver unit 107 in the next stage. It is sufficient if only the clock signal BCLK is inverted in phase with respect to the clock signal OCLK, and therefore the buffer 601 is not necessarily required. In this case, the wire of the signal ICLK is directly connected to the wire of the signal BCLK.

Figure 6B:
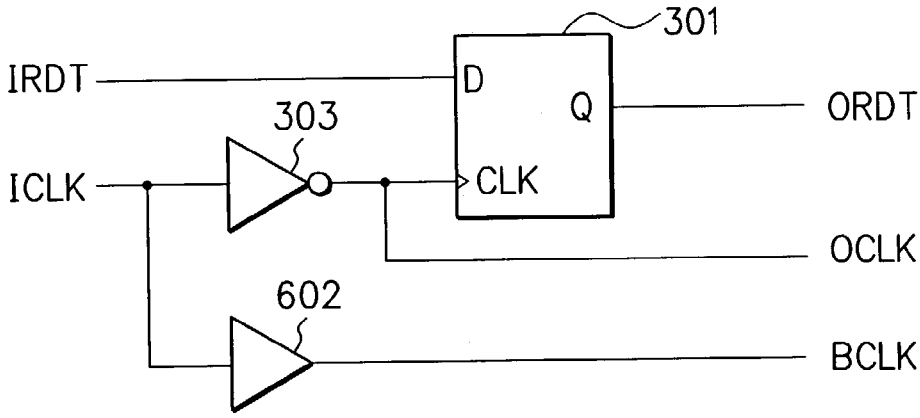

FIG. 6B shows another constitution example of the timing adjusting circuit 210*b* according to this embodiment. The circuit is the circuit in FIG. 3B provided with the buffer 602 as in FIG. 6A. In the buffer 602, the wire of the clock signal ICLK is connected to an input terminal, and the wire of the clock signal BCLK is connected to an output terminal. The buffer 602 amplifies the clock signal ICLK and outputs it as the clock signal BCLK. The operation of this circuit is the same as the timing chart in FIG. 7. Since the clock signals OCLK and BCLK have their phases inverted from each other, adverse effects by crosstalk and EMI can be further prevented.

Third Embodiment liquid crystal display according to a third embodiment of the present invention is basically the same as the constitution shown in FIG. 1 and FIG. 2, and it differs only in the internal constitution of the timing adjusting circuits 210*a* to 210*f*. The explanation will be made below with the timing adjusting circuit 210*b* as an example.

Figure 8A:
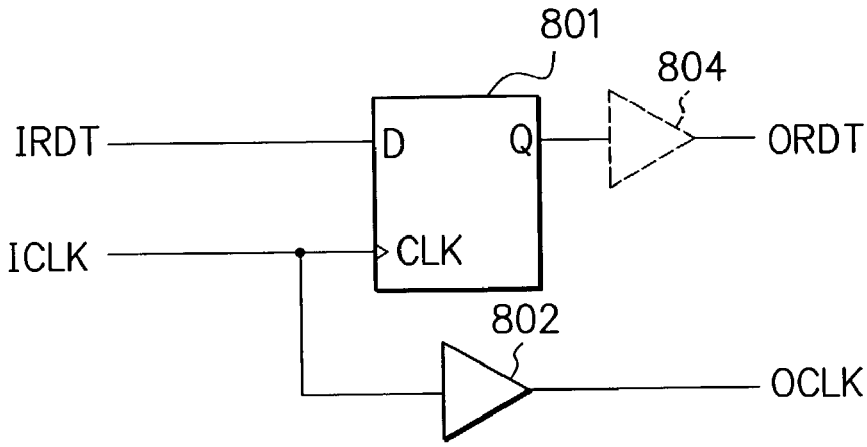
FIGS. 8A and 8B are circuit diagrams showing constitution examples of a timing adjusting circuit according to a third embodiment of the present invention.
Figure 8B:
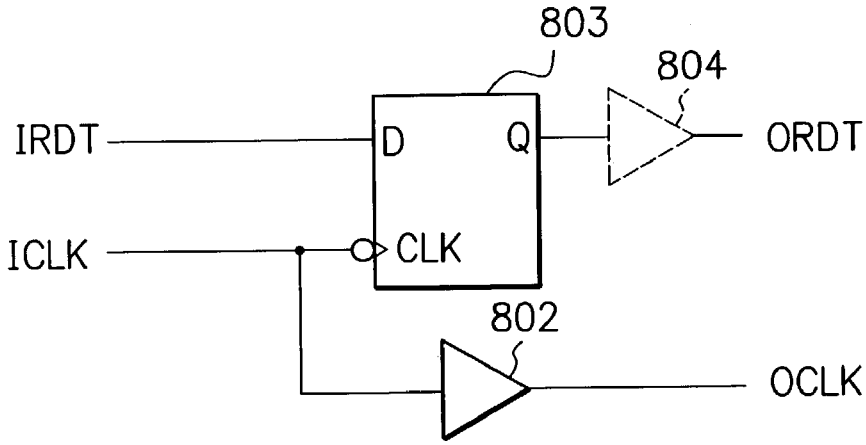

FIGS. 8A and 8B show constitution examples of the timing adjusting circuit 210*b* according to this embodiment. Of the source driver, the even-numbered source driver units 107 have the constitutions in FIG. 8A, and the odd-numbered source driver units 107 have the constitutions in FIG. 8B.

First, a constitution example of the timing adjusting circuit 210*b* of the even-numbered source driver unit 107 in FIG. 8A will be explained. In a flip-flop 801, the wire of the clock signal ICLK is connected to a clock terminal CLK, the wire of the input signal IRDT is connected to an input terminal D, and the wire of the output signal ORDT is connected to an output terminal Q. Here, the flip-flop 801 is operated in synchronism with falling of the clock signal ICLK, which is inputted into the clock terminal CLK. In a buffer 802, the wire of the clock signal ICLK is connected to an input terminal, and the wire of the clock signal OCLK is connected to an output terminal.

Figure 9A:
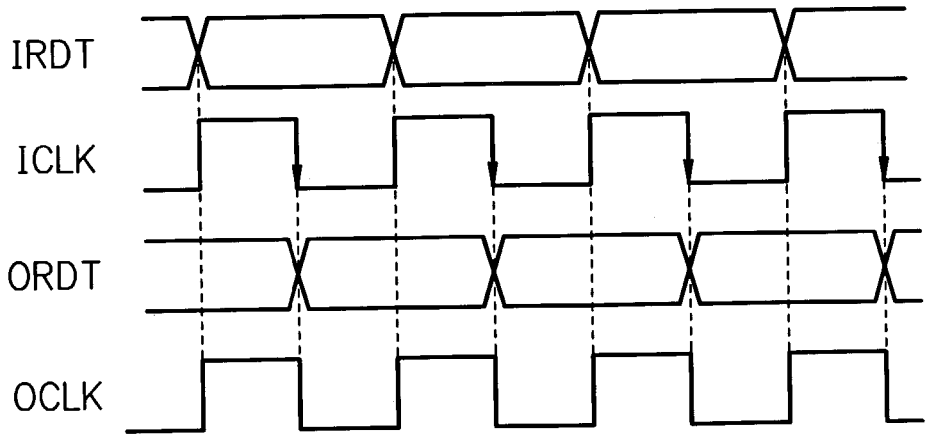
FIGS. 9A and 9B are timing charts to explain operations of the timing adjusting circuits in FIGS. 8A and 8B.

FIG. 9A is a timing chart to explain an operation of the circuit in FIG. 8A. The flip-flop 801 outputs the input signal IRDT as the output signal ORDT, in synchronism with the falling edge of the clock signal ICLK. The buffer 802 amplifies the clock signal ICLK in the same phase as it and outputs the clock signal ICLK as the clock signal OCLK.

Next, a constitution example of the timing adjusting circuit 210*b* of the odd-numbered source drive unit 107 in FIG. 8B will be explained. The circuit in FIG. 8B is provided with a flip-flop 803 instead of the flip-flop 801 in FIG. 8A. The flip-flop 803 is operated in synchronism with the rising edge of the clock signal ICLK which is inputted into the clock terminal CLK.

Figure 9B:
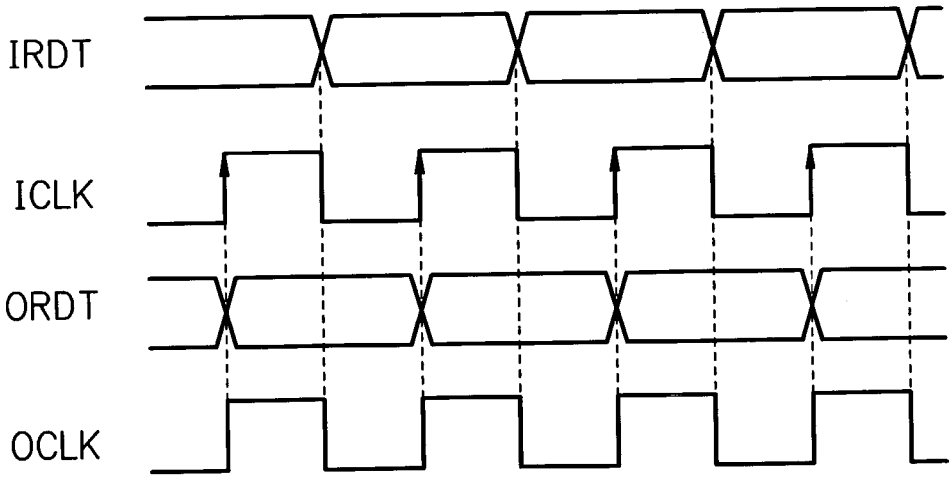

FIG. 9B is a timing chart to explain the operation of the circuit in FIG. 8B. The flip-flop 803 outputs the input signal IRDT as the output signal ORDT in synchronism with the rising edge of the clock signal ICLK. The buffer 802 amplifies the clock signal ICLK in the same phase as it and outputs the clock signal ICLK as the clock signal OCLK.

The even-numbered source driver units 107 and the odd-numbered source driver units 107 are alternately cascaded. The even-numbered circuit in FIG. 8A is operated in synchronism with the falling edge of the clock signal ICLK as shown in FIG. 9A, and the odd-numbered circuit in FIG. 8B is operated in synchronism with the rising edge of the clock signal ICLK as shown in FIG. 9B. As a result, the points of change of the output signal ORDT of the even-numbered circuit (FIG. 9A) and the output signal ORDT of the odd-numbered circuit (FIG. 9B) are deviated from each other. Thus, the peaks of crosstalk and EMI are distributed, and adverse effects by the crosstalk and EMI can be prevented.

As shown in FIGS. 8A and 8B, a buffer 804 to adjust delay time of the output signal ORDT may be provided as in FIG. 3C. In the buffers 804, the output terminals Q of the flip-flops 801 and 803 are connected to the input terminals thereof, and the wires of the output signal ORDT are connected to the output terminals. Both of the buffers 802 and 804 may be deleted. In this case, the wire of the clock signal ICLK is directly connected to the wire of the clock signal OCLK. The flip-flop 801 of the even-numbered circuit in FIG. 8A may be operated in synchronism with rising of the clock signal ICLK, and the flip-flop 803 of the odd-numbered circuit in FIG. 8B may be operated in synchronism with falling of the clock signal ICLK. It may be sufficient if both the flip-flops are operated in synchronism with the edges in the different directions.

When the source driver unit 107 is formed on the TAB 106, it is necessary to make all the source driver units 107 have the same constitutions. Thus, a pin to switch the circuit in FIG. 8A and the circuit in FIG. 8B is provided. A control signal at a high level or a low level is supplied according to the position of the pin, and it may be suitable to switch to the circuit in FIG. 8A or the circuit in FIG. 8B correspondingly to the control signal. In concrete, the flip-flop is switched to operate in synchronism with either the rising edge or the falling edge, correspondingly to the control signal. It is not limited to the case in which the source driver unit 107 is formed on the TAB 106. The source driver unit 107 may be formed on the TFT board 101 according to COG (chip on glass). The source driver unit 107 is a semiconductor chip, and the TFT board is a glass board.

As described above, according to the first and the second embodiments, the inverter inverts the input clock signal ICLK and outputs it to the source driver unit in the next stage as the output clock signal OCLK. As a result, the clock signals in the even-numbered source driver unit and the odd-numbered source driver unit are inverted from each other. The non-inverting clock signal and inverting clock signal cancel out each other, and adverse effects of crosstalk and/or EMI can be prevented. The time points of change of the output signal ORDT differ in the even-numbered source driver unit and the odd-numbered source driver unit. Consequently, the points of change of the output signals are distributed with respect to time, and the adverse effects of crosstalk and/or EMI can be prevented.

According to the third embodiment, the even-numbered source driver unit is operated in synchronism with either the falling edge or the rising edge of the clock signal ICLK, and the odd-numbered source driver unit is operated in synchronism with either the rising edge or the falling edge of the clock signal ICLK which is different from the even-numbered source driver unit. As a result, the points of change of the output signals ORDT of the even-numbered and the odd numbered source driver units are deviated from each other. Thus, the peaks of crosstalk and EMI are distributed, and the adverse effects by the crosstalk and EMI can be prevented.

The present embodiments are to be considered in all respects as illustrative and no restrictive, and all changes which come within the meaning and range of equivalency of the claims are therefore intended to be embraced therein. The invention may be embodied in other specific forms without departing from the spirit or essential characteristics thereof.

As explained above, the inverter inverts the input clock signal and outputs it to the source driver unit in the next stage. As a result, the clock signals in the even-numbered source driver unit and the odd-numbered source driver unit are inverted from each other. The non-inverting clock signal and inverting clock signal cancel out each other, and adverse effects of crosstalk and/or EMI can be prevented. The points of change of the output signal differ in the even-numbered source driver unit and the odd-numbered source driver unit, because the flip-flops are operated in synchronism with the clock signals inverted from each other. Consequently, the time points of change of the output signals are distributed, and the adverse effects of crosstalk and/or EMI can be prevented.

What is claimed is:

1. A liquid crystal display, comprising:

a transistor board having a plurality of transistors each including a gate, a source and a drain;

a common board including a common electrode and provided to oppose said transistor board via liquid crystal;

a gate driver for driving the gates of said plurality of transistors; and a source driver with a plurality of source driver units being cascaded, for driving the sources of said plurality of transistors, wherein each of said source driver units comprises:

flip-flops each with a wire of a clock signal inputted from the source driver unit in a previous stage or an outside being connected to a clock terminal, a wire of an input signal inputted from the source driver unit in the previous stage or the outside being connected to an input terminal, and a wire for outputting an output signal to the source driver unit in a next stage or the outside being connected to an output terminal;

inverters each with the wire of the clock signal inputted from said source driver unit in the previous stage or the outside being connected to an input terminal, and the wire for outputting the clock signal to the source driver unit in the next stage or the outside being connected to an output terminal; and an output circuit for outputting a signal to the source of the transistor of said transistor board correspondingly to the input signal inputted from said source driver unit in the previous stage or the outside, the liquid crystal display further comprising:

a first output wire for outputting an inverting clock signal outputted by said inverter to the source driver unit in the next stage or the outside; and a second output wire for outputting a non-inverting clock signal of the clock signal inputted from said source driver unit in the previous stage or the outside to the source driver unit in the next stage or the outside, wherein in said flip-flop, the first output wire of the source driver unit in the previous stage or the wire of the clock signal inputted from the outside is connected to the clock terminal.

2. The liquid crystal display according to claim 1, further comprising:

buffers for delay time adjustment each with the output terminal of said flip-flop being connected to an input terminal and the wire for outputting the output signal to the source driver unit in the next stage or the outside being connected to an output terminal.

3. The liquid crystal display according to claim 1, wherein display data or a control signal is inputted into the input terminal of said flip-flop.

4. A driver of a liquid crystal display in which a plurality of driver units are cascaded, wherein each of said driver units comprises:

flip-flops each with a wire of a clock signal inputted from the driver unit in a previous stage or an outside being connected to a clock terminal, a wire of an input signal inputted from the driver unit in the previous stage or the outside being connected to an input terminal, and a wire for outputting an output signal to the driver unit in a next stage or the outside being connected to an output terminal;

inverters each with the wire of the clock signal inputted from said driver unit in the previous stage or the outside being connected to an input terminal, and the wire for outputting the clock signal to the driver unit in the next stage or the outside being connected to an output terminal; and an output circuit for outputting a signal to a drive element of the liquid crystal display correspondingly to the input signal inputted from said driver unit in the previous stage or the outside, the driver further comprising:

a first output wire for outputting an inverting clock signal outputted by said inverter to the driver unit in the next stage or the outside; and a second output wire for outputting a non-inverting clock signal of the clock signal inputted from said driver unit in the previous stage or the outside to the driver unit in the next stage or the outside, wherein in said flip-flop, the first output wire of the driver unit in the previous stage or the wire of the clock signal inputted from the outside is connected to the clock terminal.

5. The driver of the liquid crystal display according to claim 4, further comprising:

buffers for delay time adjustment, each with the output terminal of said flip-flop being connected to an input terminal and a wire for outputting the output signal to the driver unit in the next stage or the outside being connected to an output terminal.

6. The driver of the liquid crystal display according to claim 4, wherein display data or a control signal is inputted into the input terminal of said flip-flop.

7. A liquid crystal display, comprising:

a transistor board having a plurality of transistors each including a gate, a source and a drain;

a common board including a common electrode and provided to oppose said transistor board via liquid crystal;

a gate driver for driving the gates of said plurality of transistors; and a source driver with a plurality of source driver units being cascaded, for driving the sources of said plurality of transistors, wherein each of said source driver units comprising:

inverters each with a wire of a clock signal inputted from said source driver unit in a previous stage or an outside being connected to an input terminal, and a wire for outputting the clock signal to the source driver unit in a next stage or the outside being connected to an output terminal;

flip-flops each with the output terminal of said inverter being connected to a clock terminal, a wire of an input signal inputted from the source driver unit in the previous stage or the outside being connected to an input terminal, and a wire for outputting an output signal to the source driver unit in the next stage or the outside being connected to an output terminal; and an output circuit for outputting a signal to the source of the transistor of said transistor board correspondingly to the input signal inputted from said source driver unit in the previous stage or the outside;

the liquid crystal display further comprising:

a first output wire for outputting an inverting clock signal outputted by said inverter to the source driver unit in the next stage or the outside; and a second output wire for outputting a non-inverting clock signal of the clock signal inputted from said source driver unit in the previous stage or the outside to the source driver unit in the next stage or the outside, wherein in said flip-flop, the first output wire of the source driver unit in the previous stage or the wire of the clock signal inputted from the outside is connected to the clock terminal.

8. The liquid crystal display according to claim 7, further comprising:

buffers for delay time adjustment each with the output terminal of said flip-flop being connected to an input terminal, and the wire for outputting the output signal to the source driver unit in the next stage or the outside being connected to an output terminal.

9. The liquid crystal display according to claim 7, wherein display data or a control signal is inputted into the input terminal of said flip-flop.

10. A driver of a liquid crystal display with a plurality of driver units being cascaded, wherein each of said driver units comprises:

inverters each with a wire of a clock signal inputted from said driver unit in a previous stage or an outside being connected to an input terminal and a wire for outputting the clock signal to the driver unit in a next stage or the outside being connected to an output terminal;

flip-flops each with the output terminal of said inverter being connected to a clock terminal, a wire of an input signal inputted from the driver unit in the previous stage or the outside being connected to an input terminal, and a wire for outputting an output signal to the driver unit in the next stage or the outside being connected to an output terminal; and an output circuit for outputting a signal to a drive element of the liquid crystal display correspondingly to the input signal inputted from said driver unit in the previous stage or the outside;

the driver further comprising:

a first output wire for outputting an inverting clock signal outputted by said inverter to the driver unit in the next stage or the outside; and a second output wire for outputting a non-inverting clock signal of the clock signal inputted from said driver unit in the previous stage or the outside to the driver unit in the next stage or the outside, wherein in said flip-flop, the first output wire of the source driver unit in the previous stage or the wire of the clock signal inputted from the outside is connected to the clock terminal.

11. The driver of the liquid crystal display according to claim 10, further comprising:

buffers for delay time adjustment each with the output terminal of said flip-flop being connected to an input terminal, and a wire for outputting the output signal to the driver unit in the next stage or the outside being connected to an output terminal.

12. The driver of the liquid crystal display according to claim 10, wherein display data or a control signal is inputted into the input terminal of said flip-flop.

13. A liquid crystal display, comprising:

a transistor board having a plurality of transistors each including a gate, a source and a drain;

a common board including a common electrode and provided to oppose said transistor board via liquid crystal;

a gate driver for driving the gates of said plurality of transistors; and a source driver with a plurality of source driver units being cascaded, for driving the sources of said plurality of transistors, wherein each of even-numbered source driver units in said source driver comprising:

flip-flops for outputting an output signal to the source driver unit in a next stage or an outside correspondingly to an input signal inputted from the source driver unit in a previous stage or the outside, in synchronism with either edge of a rising edge or a falling edge of a clock signal inputted from the source driver unit in the previous stage or the outside; and an output circuit for outputting a signal to the source of the transistor of said transistor board correspondingly to the input signal inputted from said source driver unit in the previous stage or the outside, and wherein each of odd-numbered source driver units in said source driver comprising:

flip-flops for outputting the output signal to the source driver unit in the next stage or the outside correspondingly to the input signal inputted from the source driver unit in the previous stage or the outside, in synchronism with an edge being either edge of a falling edge or a rising edge of the clock signal inputted from the source driver unit in the previous stage or the outside and being different from that of the flip-flops of said even-numbered source driver units; and an output circuit for outputting a signal to the source of the transistor of said transistor board correspondingly to the input signal inputted from said source driver unit in the previous stage or the outside;

the liquid crystal display further comprising:

a first output wire for outputting an inverting clock signal outputted by said inverter to the source driver unit in the next stage or the outside; and a second output wire for outputting a non-inverting clock signal of the clock signal inputted from said source driver unit in the previous stage or the outside to the source driver unit in the next stage or the outside, wherein in said flip-flop, the first output wire of the source driver unit in the previous stage or the wire of the clock signal inputted from the outside is connected to the clock terminal.

14. The liquid crystal display according to claim 13, further comprising:

a buffer for amplification with a wire of the clock signal inputted from said source driver unit in the previous stage or the outside being connected to an input terminal, and a wire for outputting the clock signal to the source driver unit in the next stage or the outside being connected to an output terminal.

15. The liquid crystal display according to claim 14, further comprising:

a buffer for delay time adjustment, with the output terminal of said flip-flop being connected to an input terminal, and the wire for outputting an output signal to the source driver unit in the next stage or the outside being connected to an output terminal.

16. The liquid crystal display according to claim 13, wherein display data or a control signal is inputted into an input terminal of said flip-flop.

17. A driver of a liquid crystal display with even-numbered and odd-numbered driver units being alternately cascaded, wherein each of said even-numbered driver units comprising:

flip-flops for outputting an output signal to the driver unit in a next stage or an outside correspondingly to an input signal inputted from the driver unit in a previous stage or the outside, in synchronism with either edge of a rising edge or a falling edge of a clock signal inputted from the driver unit in the previous stage or the outside; and an output circuit for outputting a signal to a drive element of the liquid crystal device correspondingly to the input signal inputted from said driver unit in the previous stage or the outside, and wherein each of said odd-numbered driver units comprising:

flip-flops for outputting the output signal to the driver unit in the next stage or the outside correspondingly to the input signal inputted from the driver unit in the previous stage or the outside, in synchronism with an edge being either edge of a falling edge or a rising edge of the clock signal inputted from the driver unit in the previous stage or the outside and being different from that of the flip-flop of said even-numbered driver unit; and an output circuit for outputting a signal to the drive element of the liquid crystal display correspondingly to the input signal inputted from the driver unit in the previous stage or the outside;

the driver further comprising:

a first output wire for outputting an inverting clock signal outputted by said inverter to the driver unit in the next stage or the outside; and a second output wire for outputting a non-inverting clock signal of the clock signal inputted from said driver unit in the previous stage or the outside to the driver unit in the next stage or the outside, wherein in said flip-flop, the first output wire of the driver unit in the previous stage or the wire of the clock signal inputted from the outside is connected to the clock terminal.

18. The driver of the liquid crystal display according to claim 17, further comprising:

a buffer for amplification with a wire of the clock signal inputted from said driver unit in the previous stage or the outside being connected to an input terminal, and a wire for outputting the clock signal to the driver unit in the next step or the outside being connected to an output terminal.

19. The driver of the liquid crystal display according to claim 18, further comprising:

a buffer for delay time adjustment with the output terminal of said flip-flop being connected to an input terminal, and the wire for outputting an output signal to the driver unit in the next stage or the outside being connected to an output terminal.

20. The driver of the liquid crystal display according to claim 17, wherein display data or a control signal is inputted into an input terminal of said flip-flop.

* * * * *